US005974938A

United States Patent [19]

Lloyd

[11] Patent Number: 5,974,938

[45] Date of Patent: Nov. 2, 1999

[54] BRAIDING MACHINE

[76] Inventor: Carter Francis Lloyd, 50 Highland St., Holden, Mass. 01520

[21] Appl. No.: 08/792,262

[22] Filed: Jan. 31, 1997

Related U.S. Application Data

[63] Continuation of application No. 08/654,048, May 28, 1996, abandoned, which is a continuation of application No. 08/433,680, May 4, 1995, abandoned, which is a continuation of application No. 07/892,503, Jun. 2, 1992, abandoned.

[51] Int. Cl.[6] ..... D04C 3/14

[52] U.S. Cl. ..... 87/56; 87/44; 87/48; 87/57; 87/61

[58] Field of Search ..... 87/20, 21, 22, 87/44, 48, 54, 55, 56, 57, 61

[56] References Cited

U.S. PATENT DOCUMENTS

| | | | |
|---|---|---|---|
| 694,536 | 3/1902 | Diss | 87/22 |
| 1,095,709 | 5/1914 | Cobb | 87/21 |
| 1,423,587 | 7/1922 | Wardwell | 87/48 |
| 1,521,597 | 1/1925 | Chace | 87/22 |
| 2,459,617 | 1/1949 | Carter | 87/21 |
| 4,616,553 | 10/1986 | Nixon | 87/48 |
| 4,719,838 | 1/1988 | DeYoung | 87/21 |
| 4,788,898 | 12/1988 | Bull | 87/57 |

FOREIGN PATENT DOCUMENTS

| | | | |
|---|---|---|---|
| 339930 | 8/1921 | Germany | 87/48 |

OTHER PUBLICATIONS

Instruction Manual "Rapid Braiders", Purnell Company Inc. Boston, MA, Dec. 1974.

*Primary Examiner*—William Stryjewski
*Attorney, Agent, or Firm*—Kenyon & Kenyon

[57] ABSTRACT

An improvement in internal cam rotary braiding machines wherein each lower carrier member thereof includes a plurality of oppositely disposed movably mounted and fixedly mounted pulleys used to convey a strand of material from a supply bobbin upwardly to the upper carrier members thereof, the pulleys being arranged to reduce the unwanted stresses which are normally imposed on the strand as it is conveyed upwardly over a deflector member and thence as it drops off the trailing edge of the deflector. Further structural improvements are made with respect to the spindle assembly used for the supply bobbin to reduce the normal movement, or "play," of the spindle assembly components during operation and, hence, to reduce further undesired stresses on the strand. The tension on the movably mounted pulleys can be adjusted to maintain a desired tension on the strand of material during the braiding operation to permit the braiding of very small filamentary materials with little or no breakage thereof during the braiding operation.

10 Claims, 6 Drawing Sheets

BRAIDING MACHINE

This application is a continuation of application Ser. No. 08/654,048 filed May 28, 1996, now abandoned, which is a continuation of application Ser. No. 08/433,680 filed May 4, 1995, now abandoned, which is a continuation of application Ser. No. 07/892,503 filed Jun. 2, 1992, abandoned.

INTRODUCTION

This invention relates generally to braiding machines and, more particularly, to improvements in braiding machines so as to permit them to reliably braid materials having extremely small diameters at reasonable cost and at reasonably high speed production rates.

BACKGROUND OF THE INVENTION

Braiding machines have long been known in the art for braiding multiple strands of materials, e.g., synthetic plastics or metals, such as copper or stainless steel wire, at reasonably high production rates. One type of braiding machine, which is commonly referred to as an internal cam rotary braider, has been known to the art for many years, being generally designated as the Wardwell Rapid Braider, made and sold by Wardwell Braiding Machine Company of Central Falls, R.I. (the "Wardwell" machine). Wardwell rotary braiding machines have been available in various sizes, depending on the number of strands required in the final braided output, and have been in use for many decades since the first designs thereof were made available about the turn of the century. Their reliability and relatively high speed of operation have been well recognized and such machines have been used satisfactorily over the years, normally requiring only the replacement of parts, their structure and operation having essentially remained unchanged since their original design.

As it becomes desirable, or necessary, to braid strands or filaments of material, particularly very fine copper or stainless steel wire materials, having extremely small diameters, e.g., as small as 0.0005–0.0030 inches, or less, it has been found that the Wardwell machine becomes unreliable because the rotary technique used therein produces so much tension on very small diameter materials, particularly at one stage of the braiding process, that such extremely fine filaments tend to break relatively easily and quickly, thereby automatically stopping the machine.

In an effort to braid such extremely fine filaments without significant breakage thereof, those in the art have turned to the use of other types of braiding machines, such as machines often ref erred to as "maypole" braiding machines, sold by the New England Butt Division of Wardwell Braiding Machine Company and by Steeger U.S.A., Inc. of Spartanburg, N.C., as well as machines often referred to as external cam rotary braiding machines, such as sold, for example, by Hacoba Textile Machinery of Charlotte, N.C. While such other types of machines tend to operate with some degree of success when used with relatively small diameter strands, the initial purchase and installation costs, as well as the operating costs thereof, tend to be higher than those of internal cam Wardwell machines, and the speeds of operation and, hence, the production rates thereof are often significantly lower than those of internal cam Wardwell machines.

It would be desirable, therefore, if the art could take advantage of the lower cost and higher operating speeds of the Wardwell rotating braiding machines by appropriately adapting such machines in a manner which would permit them to braid extremely fine materials without encountering the significant breakage problems discussed above and without unduly raising the costs of purchasing and operating such machines.

BRIEF SUMMARY OF THE INVENTION

In accordance with the invention, such adaptation has been achieved by re-designing the conventionally used lower carrier members of a typical Wardwell rotary braiding machine so as to replace such members with a new design that provides a structure and operation which considerably reduces the unwanted stresses placed on a strand of material being handled thereby, particularly when using extremely fine copper or stainless steel wires or filaments, so that the tendency for such materials to break is effectively eliminated, even for materials having diameters down to as small as 0.0005 inches, or less.

In a particular embodiment thereof, a lower carrier member includes a plurality of oppositely disposed pulleys for conveying a strand of material from the supply bobbin upwardly to the region where the upper carrier members of the machine are located, the upwardly moving strand being suitably deflected to move over the upper carrier members so that the braiding thereof with the strands of material supplied by the upper carrier members can take place. The use of such a uniquely designed pulley arrangement considerably reduces the unwanted stresses which are normally imposed on the wire, particularly very small diameter wire, as it is being conveyed over a deflector element and thence as it drops off the trailing edge of the deflector during its upward movement. The spindle used for the supply bobbin on the lower carrier member has also been re-designed so as to be mounted in a manner which considerably reduces the normal movement, or "play", thereof during operation. By appropriately adjusting the tension on the pulley arrangement of the lower carrier member, the movement of the strand can be effectively controlled so as to maintain a desired tension for braiding purposes while reducing unwanted stresses placed on the strand during the braiding operation so as to permit the braiding of very small filamentary materials essentially without breakage.

DESCRIPTION OF THE INVENTION

The invention can be described in more detail with the help of the accompanying drawings wherein FIG. 1 shows diagrammatically an arrangement of upper and lower bobbins which is helpful in describing the general operation of a prior art Wardwell machine;

The structure and operation of a typical Wardwell machine is well-known to the art and is described in the instruction manuals available with such machines, such manuals for a typical machine being normally designated as "Wardwell Instruction Manual, Rapid Braiders" as supplied by Wardwell Braiding Machine Co., Central Falls, R.I.

Figure 1:
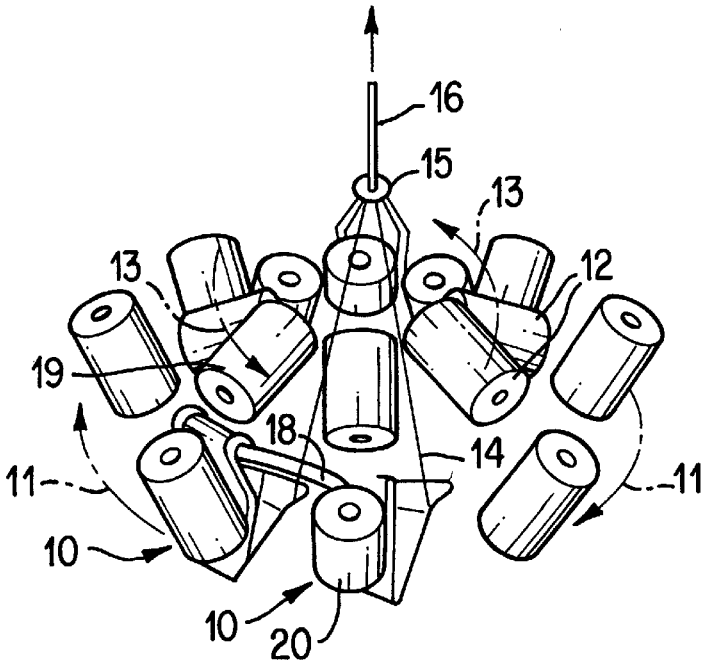
FIG. 1 PRIOR ART

FIG. 1 is an illustration adapted from a typical manual, and depicts diagrammatically the operation of a typical well-known Wardwell machine as described therein and as would be well known to those in the art. As can be seen therein, a plurality of lower carrier members 10, shown only diagrammatically in FIG. 1 and in more structural detail in FIG. 2, move in the direction of arrows 11, while a plurality of upper carrier members 12 move past lower carrier members 10 in the opposite direction, as shown by arrows 13. A strand 14 of material is supplied from a bobbin 20 on each lower carrier for intertwining with strands (not shown) supplied from a bobbin 19 on each upper carrier member, a strand from the lower carrier, for example, passing over one upper carrier member, then under the next adjacent upper carrier member, then over the next adjacent upper carrier member, and so on, as the upper and lower carriers move past each other in opposite directions. The intertwined strands are supplied to a braiding guide 15 which produces the braided output 16 therefrom. As each strand from a lower carrier member encounters the leading edge of deflector 18, it is lifted up and over an upper carrier member as it moves along the deflector, the strand then dropping off the trailing edge of the deflector so as to pass under the next adjacent upper carrier member.

Figure 2:
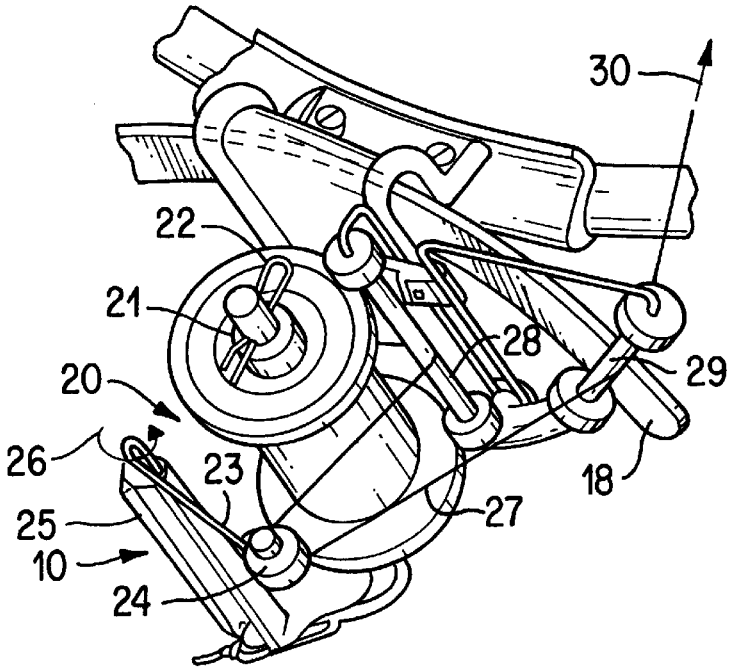
FIG. 2 PRIOR ART
FIG. 2 shows a perspective view of a typical lower carrier member as used in a prior art Wardwell machine.

A more detailed illustration of a typical lower carrier member 10 as used in current Wardwell machines is shown in FIG. 2. As seen therein, a bobbin 20 is mounted on a suitable spindle 21 and is retained thereon by a safety pin 22. A lower tension lever 23, having a pulley 24 mounted on its horizontal arm, is spring mounted on a lower tension lever retainer 25. The lever 23 is mounted by a suitable spring arrangement on the lower tension lever retainer so that its vertical arm is rotatable about its vertical axis, substantially parallel to the axis of spindle 21, as shown by arrow 26, so that pulley 24 moves generally in a direction perpendicular to the axis of bobbin 20.

A strand of material, such as a copper wire 27, from a spool thereof on bobbin 20 is supplied therefrom via a first thread guide roller element 28, thence to and around pulley 24 to a second thread guide roller element 29, and thence upwardly to the upper carrier members 12 and braiding guide 15, as shown by arrow 30.

Figure 5:
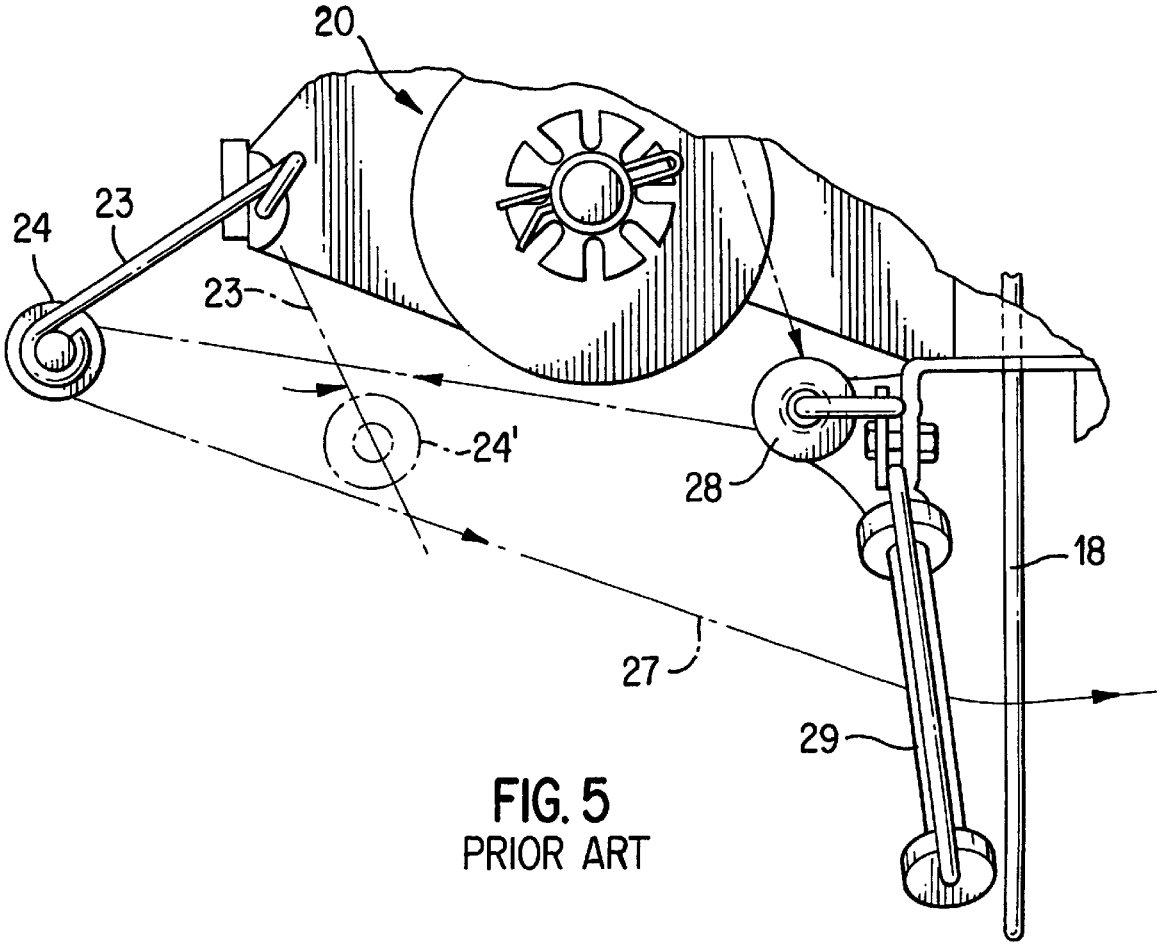
FIG. 5 PRIOR ART
FIG. 5 shows a perspective view from below of a portion of the prior art lower carrier member of FIG. 2.

As a strand on lower carrier member 10 moves relative to the upper carriers, it encounters the leading edge of a deflector 18 and rides over the upper surface of the deflector so as to lift the strand up and over an upper carrier member. As the strand moves over deflector 18, the lower tension lever 23 is rotated under spring tension so as to move pulley 24 from an initial position inwardly toward bobbin 20. As best shown in FIG. 5, pulley 24 is in its initial position as it reaches the leading edge of a deflector and, when the strand reaches the highest region on the surface of the deflector, the lower tension lever 23 and pulley 24 move to their maximum spring-deflected position as shown by dashed line 23' and pulley 24'. When the strand drops off the trailing edge of the deflector so as to permit the strand to drop to a lower position so as to pass under the next adjacent upper carrier, the spring action causes the lower tension lever 23 to snap back and return very rapidly to its initial position. Such operation produces a sufficient unwanted stress, or force, on the strand such that very small diameter strands break relatively easily at such stage of the operation, particularly when using very fine metallic wire, such as copper wire or stainless steel wire, which wires tend to be somewhat brittle and less resilient to such a rapid increase in longitudinal tension placed thereon during the rapid return motion.

In order to avoid such breakage problems on a Wardwell type braiding machine, the invention utilizes a new design for the lower carrier members thereof, a preferred embodiment of which is illustrated with reference to FIGS. 3, 4, 6 and 7. As seen therein, a bobbin 30 is suitably positioned on a rotating spindle 31, the particular structure of which is improved over that conventionally used in such machines, as discussed in more detail below. Lower tension lever 33 has mounted on its horizontal arm at least two pulleys 34 and 35 and, in the particular embodiment depicted, an additional pulley 36. Two additional pulleys 37 and 38 are fixedly mounted on the lower carrier member via a suitable mounting block 39 suitably affixed to the frame thereof. Pulleys 37 and 38 are displaced from pulleys 34, 35 and 36 and are positioned near a first thread guide roller element 40 as shown. A second thread guide element 41 is fixedly attached, as shown, to block 39 and to the frame of the lower carrier member. A strand 42, e.g., of copper wire, is supplied from bobbin 30 around first thread guide roller element 40 and thence around pulley 36 in a counter-clockwise direction to the bottom of pulley 37, exiting therefrom and returning to and around pulley 35 in a counter-clockwise direction, thence to the bottom of pulley 38, exiting therefrom and returning to and around pulley 34 in a counter-clockwise direction, and thence to second thread guide element 41 and upwardly toward the upper carrier members, as shown by arrow 44. Thus, the wire leaves the upper tension lever at substantially the same height as in the prior used structure shown in FIG. 2.

Figure 6:
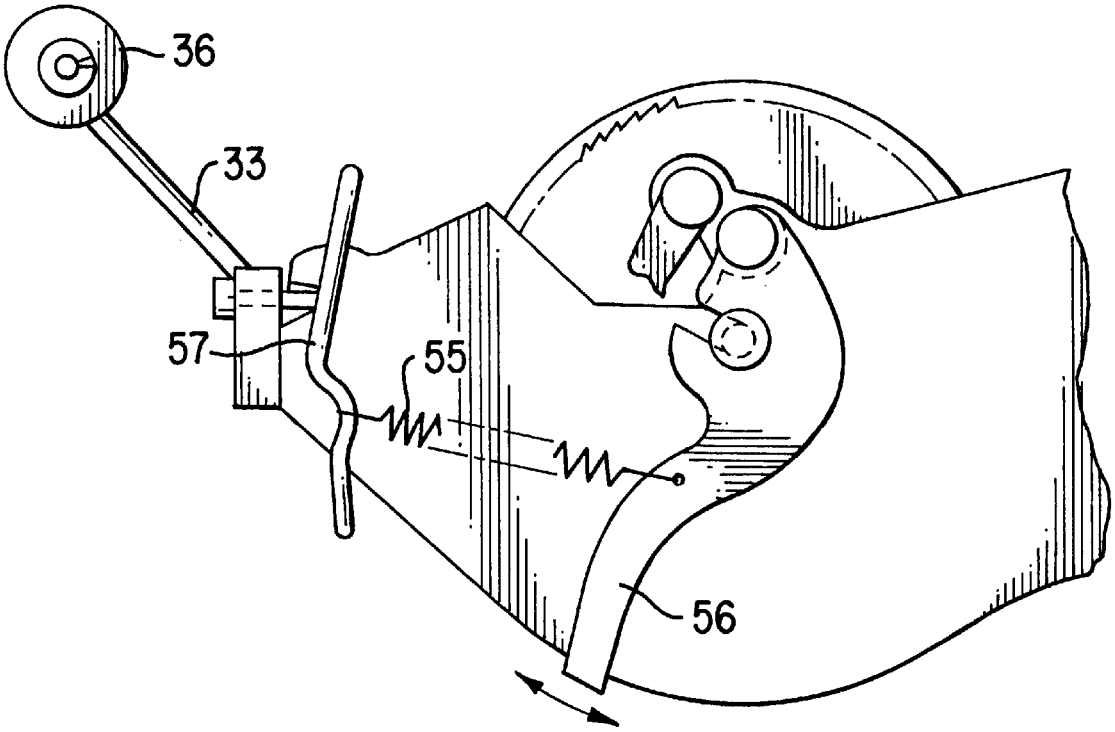
FIG. 6 shows the perspective view from below of another portion of the lower carrier member of FIG. 3.

Tension on the lower tension lever 33 is maintained by a tension spring 55 as shown in FIG. 6 which can be adjusted by tension adjustment arm 56 via linkage 57 in a manner which is well-known to those in the art having familiarity with Wardwell machines to provide a desired tension on the wire for the braiding operation.

Wire 42 encounters the leading edge of fixedly mounted deflector 18 as the lower carrier member moves in the direction of arrow 43. Wire 42 moves along the upper surface of deflector 18 to its highest deflection point and then along the rest of the deflector surface until it drops off the trailing edge thereof in substantially the same manner as discussed above with respect to the lower carrier member of FIG. 2.

Figure 3:
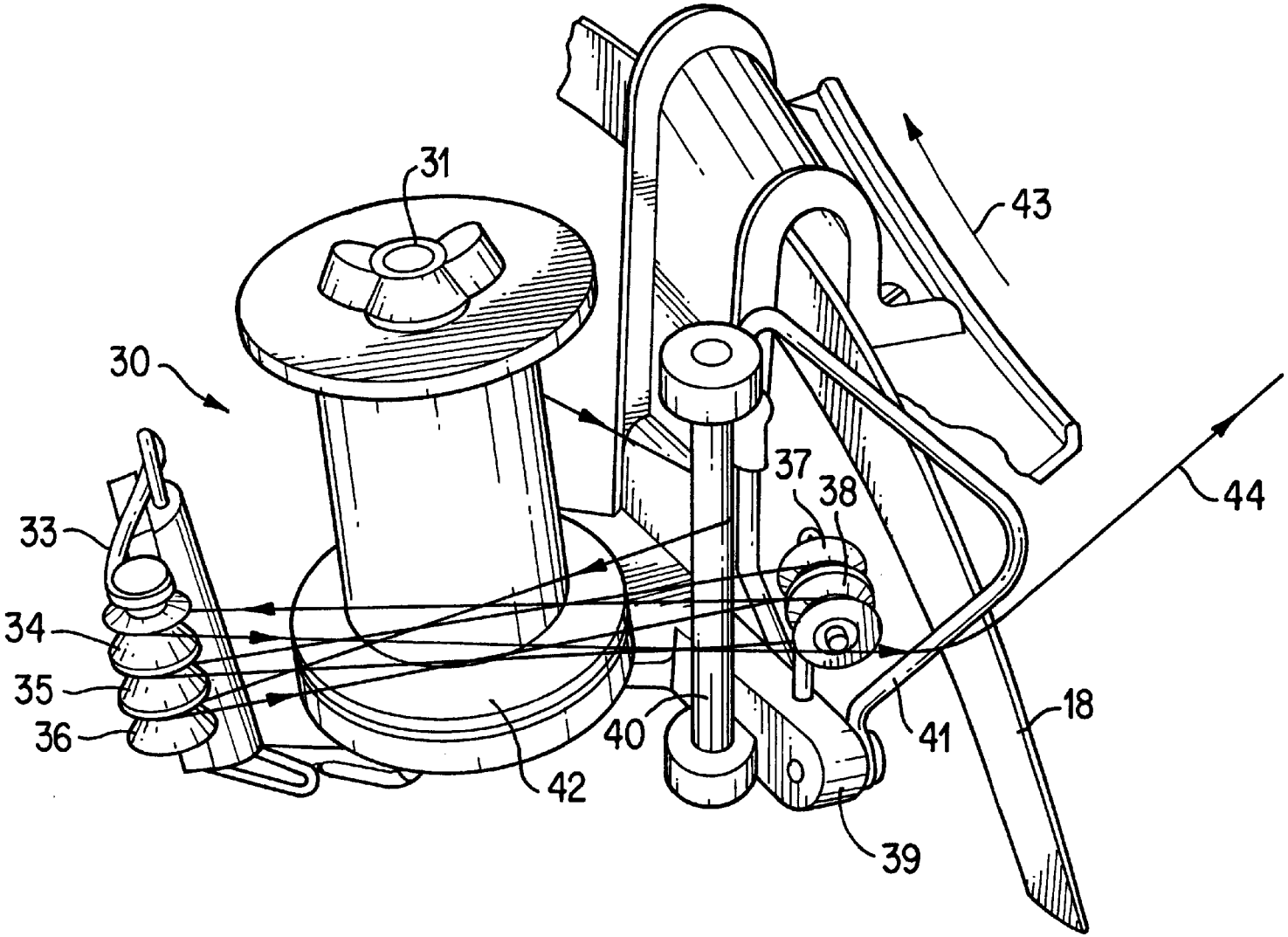
FIG. 3 shows a perspective view of a lower carrier member in accordance with the invention.
Figure 4:
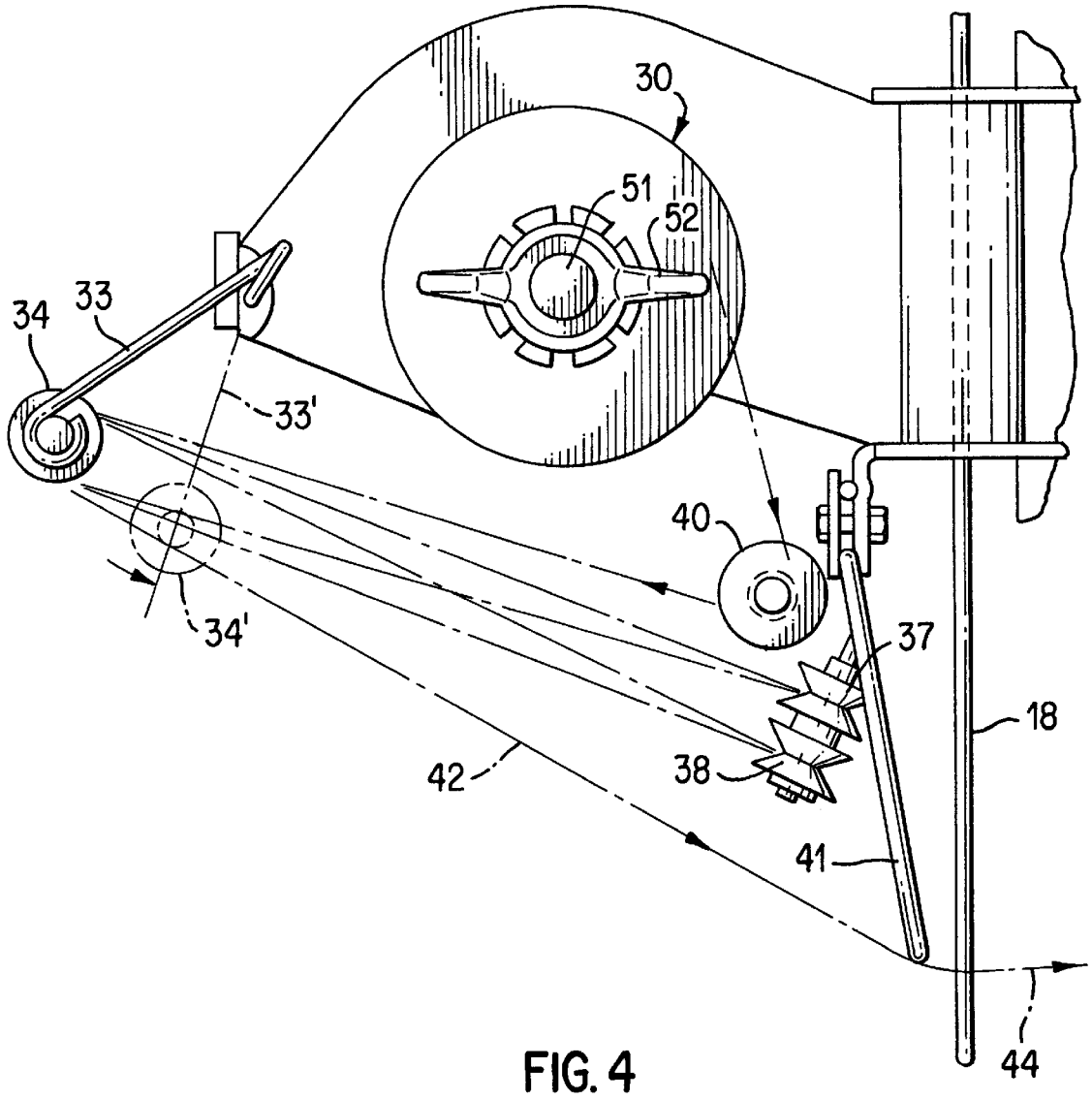
FIG. 4 shows a perspective view from below of a portion of the lower carrier member of FIG. 3.

As wire 42 moves to its highest point along the deflector, lower tension lever 33 rotates to its maximum deflection position as shown in dashed line 33' and pulley 34' in FIG. 4. As can be seen, the movement of lower tension lever 33 in FIG. 4 is much less when using the pulley arrangement of FIG. 3 than the movement of lower tension lever 23 in FIG. 5 which occurs when using the prior art design. Accordingly, as the wire 42 drops off the trailing edge of deflector 18, the distance and rate at which the lower tension lever 33 returns to its original position is reduced and the unwanted stresses placed on the wire 42 are considerably decreased. It has been found that, because of such improved operation, the tendency of wire 42 to break is effectively eliminated even when using wire having a diameter down to a value as small as 0.0005 inches, or less. It has been further found, for example, that when handling wire of such fine diameter, the machine can be run continuously for time periods as long as 40 hours, or more, for example, without breakage. In comparison, when such fine diameter wire is attempted to be braided using the conventional lower carrier member of FIG. 2, breakage usually occurs within less than a few minutes and, in many cases, within less than a minute.

Figure 8:
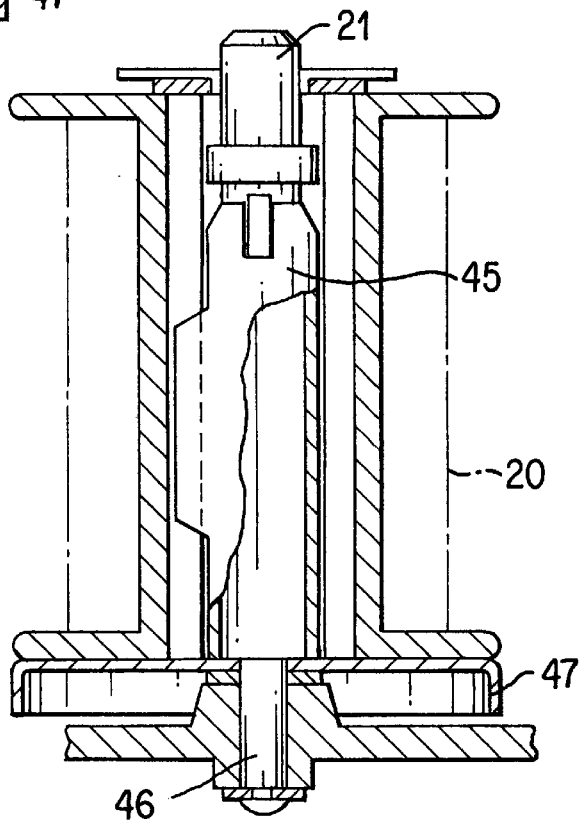
FIG. 8 PRIOR ART
FIG. 8 shows a view in section of the spindle and bobbin assembly used in the prior art lower carrier member of FIG. 2.

With respect to another aspect of the invention, although not absolutely necessary, it has been found that further improvement in assuring the elimination of breakage can be achieved by improving the rigidity of the bobbin and spindle assembly of the lower carrier member. As can be seen in FIG. 8, the spindle 21 of the prior art assembly is inserted into a sleeve 45, the reduced diameter lower end 46 of the spindle being in turn fixedly attached to a ratchet element 47. As the ratchet element 47 is rotated through discrete positions, the spindle end 46 is rotated so as to feed wire discretely from bobbin 20, in a manner well-known to those in the art. However, because of the structure utilized for such overall assembly, both longitudinal and lateral motions of the sleeve, spindle and bobbin elements occur, i.e., there is relatively significant "play" for such elements during operation. Such movements tend to aggravate the breakage problem since the supply of wire cannot proceed in a smooth enough manner to avoid the abrupt and undesired stresses placed thereon due, in part, to such significant play.

Figure 7:
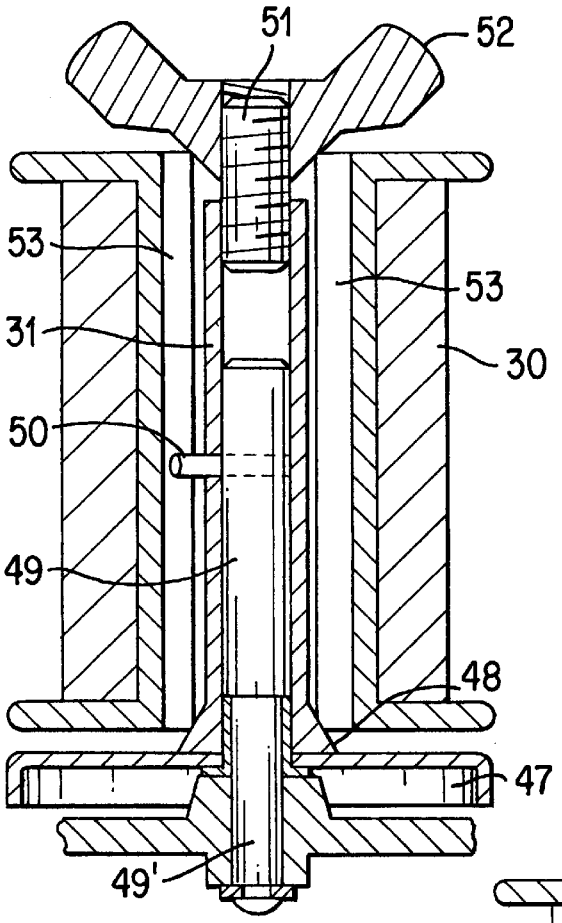
FIG. 7 shows a view in section of the spindle and bobbin assembly used in the lower carrier member of FIG. 3.

A re-design of the bobbin and spindle assembly, as shown in FIG. 7, overcomes such added undesired stress problems and further assists in eliminating the breakage problem. As seen therein, a sleeve 31 is machined so that its lower end portion 48 is tapered outwardly as shown and is welded, or otherwise affixed, to the ratchet element 47. Spindle 49 is inserted in sleeve 31, and is then retained therein by means of a set screw 50 which is tightened on to a suitably flattened portion of spindle 49, the reduced diameter lower end 49' of spindle 49 being attached to ratchet 47. A threaded shaft element 51 is inserted into and threaded on to the upper end of sleeve 31 and a wing nut 52 is threaded thereon to rigidly retain the sleeve in the assembly. The lower surfaces of the wing nut 52 are tapered inwardly as shown so that when the bobbin is positioned on sleeve 31, it is retained thereon by the tapered portions of wing nut 52. The somewhat resilient central element 53 at the lower and upper ends of bobbin 30 are rigidly held in the assembly by the tapered portion 48 of sleeve 31 and the tapered portion of wing nut 52, respectively. Accordingly, substantially little or no relative movement of the bobbin, the spindle, and the sleeve occurs and the bobbin, spindle, sleeve, and ratchet elements are maintained as a substantially rigid assembly during operation of the machine. It is found that the use of such a rigid assembly further enhances the operation of the machine in a manner which assists in eliminating breakage of the material being braided, particularly for very fine diameter metal wire materials, as discussed above.

While the embodiment of the invention depicted in FIG. 3 shows the use of three movable pulleys at the lower tension lever 33 and two fixed pulleys used therewith, it has been found that two movable pulleys and a single fixed pulley are sufficient in many cases to adequately reduce the motion of the lower tension lever 33 and, hence, to reduce the unwanted stresses on the strand to be braided so as to prevent breakage thereof. It has been found that the greater the number of movable and fixed pulleys used, the less the motion of the lower tension lever 33 and the greater the assurance that undesired stresses will be reduced and breakage will not occur. Although even more pulleys than shown in FIG. 3 can be used, practical considerations indicate that arrangements using two movable pulleys and one fixed pulley or using three movable pulleys and two fixed pulleys are usually adequate for handling wires having diameters down to as low as 0.0003 inches or less. Additional pulleys can be used, however, if found helpful or necessary.

While the above description discloses preferred embodiments of the invention, modifications thereto may occur to those in the art within the spirit and scope of the invention and, hence, the invention is not to be construed as limited to the particular emboidments discussed above, except as defined by the appended claims.

What is claimed is:

1. A method for braiding fine strand with cross-section of less than 0.0041 inch using a rotary braider having upper and lower carriers, the rotary braider running at at least fifty revolutions per minute, reducing the tension on the fine strand so that no strand breaks during braiding for a period of time of at least twenty minutes, comprising the steps of:

a. arranging a supply of strands on the upper and lower carriers of the rotary braider, each said strand having a cross-section of less than 0.0041 inch;

b. threading each strand from the strand supply through the braiding guide;

c. reducing the tension exerted on each strand between the strand supply and the braiding guide such that no strand breakage occurs for a period of time of at least twenty minutes when the braider is operated at at least fifty revolutions per minute;

d. fixing the strand that has been threaded through the braiding guide; and e. operating the braider at at least fifty revolutions per minute.

2. The method of claim 1, wherein the strand is a single filament of stainless steel wire having a cross section of 0.0015 inch.

3. The method of claim 1, wherein the strand comprises three filaments of copper wire, each filament having a cross section of 0.003 inch.

4. The method of claim 1, wherein reducing the tension exerted on the strand in step c of claim 1 comprises the steps of:

a. threading the strand from a lower carrier strand supply around a first pulley mounted on a tension lever, the tension lever mounted on the frame of the rotary braider;

b. threading the strand from the first pulley to a second pulley mounted on the frame of the rotary braider; and c. threading the strand from the second pulley to a third pulley mounted on the tension lever and to the braiding guide.

5. The method of claim 1, wherein fixing the strand in step d of claim 1 comprises the step of fixing the strand to a take-up wheel.

6. The method of claim 1, wherein fixing the strand in step d of claim 1 comprises the step of fixing the strand to a core.

7. An apparatus for braiding, comprising:

a strand supply that provides a strand having a cross section of less than 0.0041 inch;

a rotary braider for braiding the strand at a braiding guide, said rotary braider having a frame and a tension lever;

a device for reducing the tension applied to to the strand so that the strand does not break for a period of at least twenty minutes when said rotary braider operates at fifty revolutions per minute or faster, said device comprising:

a first pulley mounted on said tension lever, the strand being threaded from said strand supply around said first pulley;

a second pulley mounted on said frame, the strand being threaded from said first pulley around said second pulley; and a third pulley mounted on said tension lever, the strand being threaded from said second pulley around said third pulley and toward the braiding guide.

8. The apparatus of claim 7, wherein said third pulley is mounted below said first pulley on said tension lever.

9. The apparatus of claim 7, wherein the axis of rotation of said first pulley and said third pulley is perpendicular to the axis of rotation of said second pulley.

10. An apparatus for braiding strand on a rotary braider, comprising:

a. means for supplying fine strand having a cross-section of less than 0.0041 inch;

b. means for braiding the strand at a braiding guide;

c. means for reducing the tension exerted on the strand between said supply means and said braiding guide such that the strand does not break for a period of at least twenty minutes when the rotary braider is operated at at least fifty revolutions per minute.

* * * * *